United States Patent [19]

Campbell, Jr.

[11] 4,148,376

[45] Apr. 10, 1979

[54] APPARATUS ADAPTED FOR MULTIPURPOSE USE SUCH AS A TREE STAND, BACKPACK FRAME OR THE LIKE

[76] Inventor: Carl C. Campbell, Jr., 909 McKimmon Rd., Fayetteville, N.C. 28303

[21] Appl. No.: 856,219

[22] Filed: Dec. 1, 1977

[51] Int. Cl.[2] ..... A45F 4/02; A45F 3/10; A45F 3/26

[52] U.S. Cl. ..... 182/20; 182/187

[58] Field of Search ..... 182/20, 187; 224/9, 224/8 R; 297/230

[56] References Cited

U.S. PATENT DOCUMENTS 3,006,433 10/1961 Farver ..... 224/9

3,292,830 12/1966 Mack ..... 224/9

*Primary Examiner*—Reinaldo P. Machado

*Attorney, Agent, or Firm*—Mills & Coats

[57] ABSTRACT

The present invention relates to a multipurpose apparatus that may be used, for example, as a tree stand or backpack frame or the like. Structurally, the apparatus comprises a main frame structure having a seat pivotably mounted about one area thereof and a back area provided above said seat within said main frame structure. Straps are provided about said main frame structure for enabling the apparatus to be strapped about a tree or other structure, or to be utilized as shoulder straps for supporting the apparatus about an individual when the apparatus is used as a backpack frame.

9 Claims, 4 Drawing Figures

APPARATUS ADAPTED FOR MULTIPURPOSE USE SUCH AS A TREE STAND, BACKPACK FRAME OR THE LIKE

The present invention relates to utility apparatuses and more particularly to an apparatus of the type that may be utilized in numerous functional manners such as a tree stand or backpack frame or the like.

BACKGROUND OF THE INVENTION

In the past, tree stands, as commonly used in hunting, have often been constructed on a tree and secured to the tree in a permanent fashion. These early stands, made mostly of wood, were both functional and inexpensive to build. However, the construction of such tree stands was time consuming and since they were permanently attached to the tree, such tree stands were not portable and consequently did not lend themselves for use in other hunting areas.

The development of portable tree stands increased their use by hunters because they were marketed as a preassembled unit that could be temporarily secured to a tree and moved to other locations if so desired. Generally some portable tree stands were designed as a convertible backpack whereby they could easily be carried by a hunter to the location of their intended use. In addition as seen in the prior art, many known portable tree stands are bulky, heavy, complicated in construction and expensive to manufacture.

Many of the portable tree stands that are in use today incorporate a supporting means that severs the bark from a tree when the stand is secured in place. Since the portable tree stand has become a widely accepted piece of equipment to the hunter, it should be appreciated that a great deal of damage can be done in a forest by their use. Recent public awareness and acceptance of conservation of the environment has prompted criticism of portable tree stands that harm trees and consequently such types are not going to be readily acceptable to much of the purchasing public.

SUMMARY OF INVENTION

The apparatus of the present invention has been developed to provide the hunter with a portable tree stand that may be readily converted to a convertible backpack frame, and generally used for a wide variety of purposes. Additionally, the portable tree stand of the present invention is simple in construction and relatively inexpensive to produce.

Basically the apparatus of the present invention comprises a main frame having two laterally spaced, parallel elongated side members with the upper area between the elongated members forming a back support and the lower area between the elongated members adapted to support a seat which is pivotably mounted between the lower extension of the elongated frame side members. Additionally, the apparatus of the present invention incorporates two top straps being removably attached to the frame and adapted to support the frame in either the backpack mode or to secure the frame to a tree when the apparatus is used in the tree stand mode. A third intermediately disposed strap is secured midway across said elongated frame members and provides support for the portable tree stand frame when used either in the backpack or tree stand mode.

It is, therefore, an object of the present invention to provide a multipurpose apparatus that can easily and conveniently be utilized as a portable tree stand or as a backpack frame.

Still a further object of the present invention resides in the provision of a convertible apparatus as set forth in the immediately above paragraph that can be used in a variety of ways including use as a carrier for firewood, wild game, etc., and even utilized as a camp or fishing seat.

It is also an object of the present invention to provide an apparatus of the type that may be generally referred to as a convertible portable tree stand-backpack frame that is of a lightweight construction and particularly designed so that a single individual can easily handle and carry the apparatus.

A further object of the present invention is to provide an apparatus of the type that can be utilized as a portable tree stand or as a backpack frame that has substantial versatility in that the apparatus can be used for many purposes.

Another object of the present invention is to provide a portable tree stand which is simple in construction, durable, and relatively inexpensive to produce.

A further object of the present invention is to provide a portable tree stand which when properly secured to a vertically extending tree trunk, will provide a stationary platform on which an individual may sit.

An even further object of the present invention is to provide an apparatus that may be converted to a portable tree stand or to a backpack frame wherein a standard material pack may be attached to the main frame structure.

Other objects and advantages of the present invention will become apparent from a study of the following description and the accompanying drawings which are merely illustrative of the present invention.

DESCRIPTION OF PREFERRED EMBODIMENT

Figure 1:
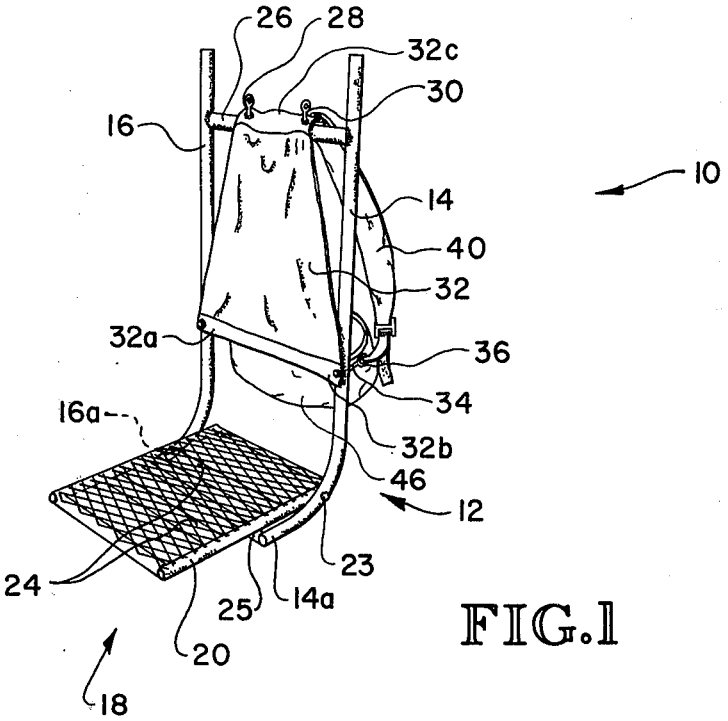
FIG. 1 is a perspective view of the multipurpose apparatus of the present invention.

With further reference to the drawings, the multipurpose apparatus of the present invention is shown therein and indicated generally by the numeral 10. Viewing apparatus 10 in detail, it is seen that the same comprises a main frame structure indicated generally by the numeral 12.

Main frame structure 12 comprises two laterally spaced side members 14 and 16, preferably constructed of aluminum tubing, with the side members 14 and 16 being secured together by a top cross member 26. In addition, another cross member is secured between side members 14 and 16 and this cross member is referred to by the numeral 25 and is referred to as a seat support member or bar since the same acts to support or retain a seat structure to be discussed in more detail subsequently herein.

Figure 2:
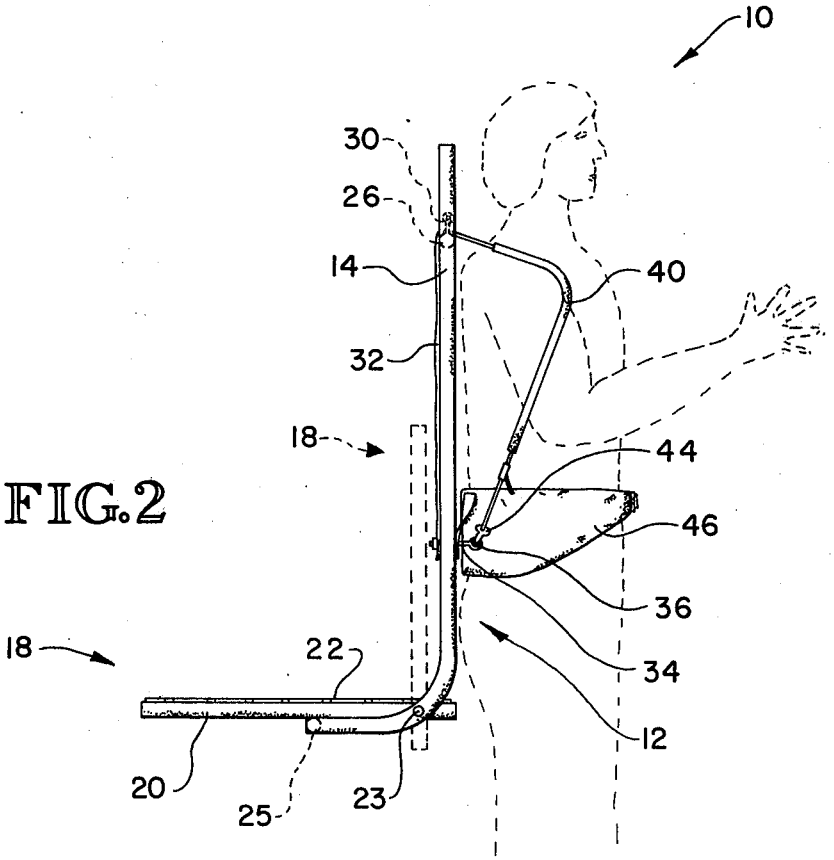
FIG. 2 is a side elevational view of the multipurpose apparatus particularly illustrating its use as a backpack frame and with the seat being shown in dotted lines in the vertical position.
Figure 3:
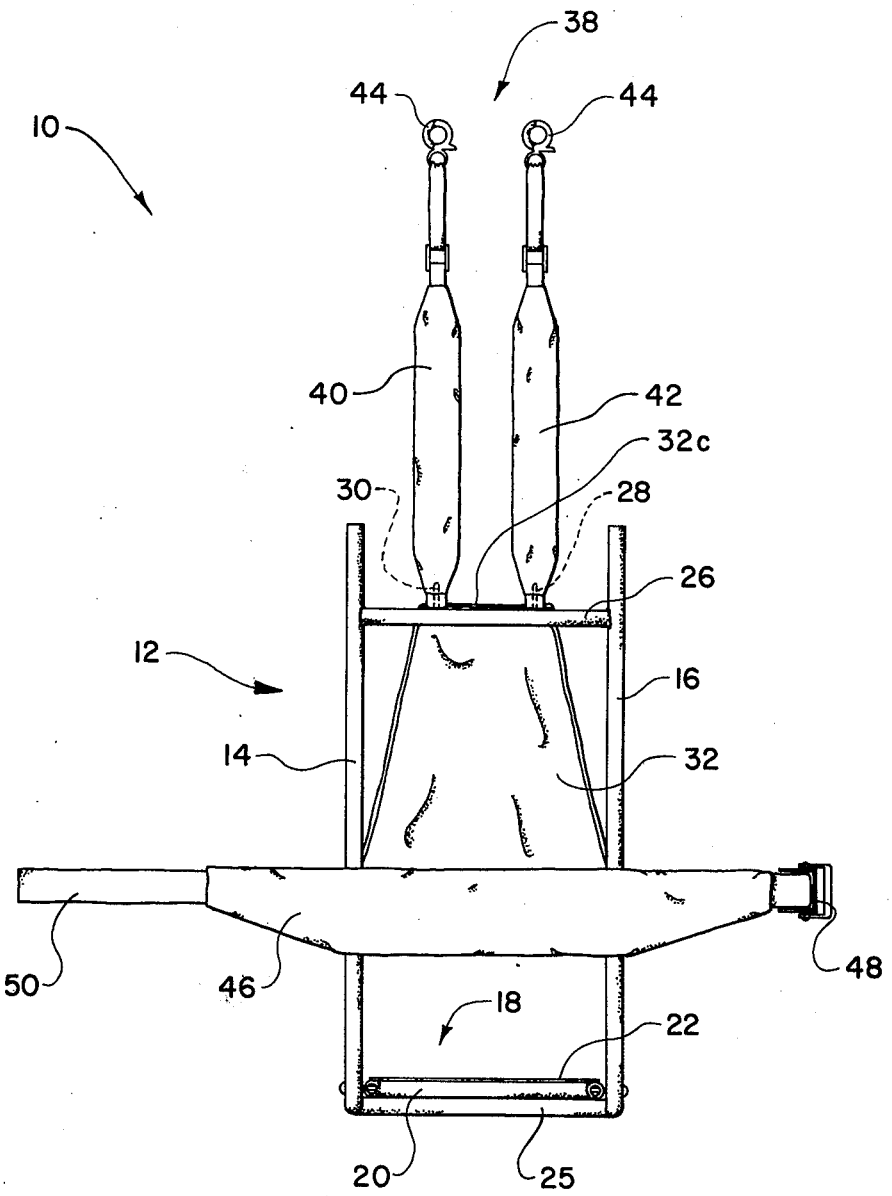
FIG. 3 is a rear elevational view of the apparatus of the present invention with the individual straps being shown in an extended position to better illustrate the relationship of the straps with other components of the apparatus.

As viewed in FIGS. 1 and 2, the lower portion of the main frame structure includes a seat support area and such is provided for by curving the respective ends of side members 14 and 16 to form curved ends 14*a* and 16*a* that extends outwardly from the main frame structure generally perpendicular to the side member portions extending thereabove.

A seat, indicated generally by the numeral 18 is pivotably mounted about a transverse axis between said laterally spaced side members 14 and 16 in the area where the side members are curved. More particularly, seat 18 is supported by a pivot pin assembly 23 on each side thereof and is movable from a generally horizontal support position (full lines in FIG. 2) to a vertical position (dotted lines in FIG. 2). Pivot pin assembly 23 may be of any conventional design that would allow seat 18 to pivot. It is contemplated, however, that the pivot pin assembly would be provided with a conventional locking nut to assure that the pivot pin would not easily slip from its supporting position. In the horizontal support position, the cross bar 25 extending between the curved ends 14*a* and 16*a* acts to retain or support the seat 18 and prohibit the same from pivoting further counterclockwise as viewed in FIG. 2.

Seat 18 includes a rectangular tubular frame structure 20 with an expanded metal seat 22 secured thereto by weldment or other suitable means. It is desirable that material making up the seat be of a lightweight type such as aluminum so as to minimize the weight of the apparatus. Reenforcing strips 24 extend across the rectangular frame 20 of the seat and underneath the expanded metal seat 22 in order to reenforce the same.

The portion of the main frame structure 12 above the seat 18 is referred to as the back area of the apparatus. Top cross member 26 is secured between the laterally spaced side members 14 and 16 about the upper back area. A pair of spaced apart studs 28 and 30 are secured to top cross member 26 and extends upwardly therefrom and each includes an eyelet formed on the end thereof.

For providing a backrest for the apparatus of the present invention, a flexible cloth like material 32 of nylon or other suitable material is secured about the back area of said main frame structure and extends generally between the laterally spaced side members 14 and 16. More particularly, the flexible cloth like material 32 includes lower edges 32*a* and 32*b* that are secured to points on the laterally spaced side members 14 and 16 by a stud assembly 34 that extends longitudinally through each respective side members 14 and 16 and includes an attaching eyelet 36 formed about the back side thereof. In addition, the flexible cloth like material 32 includes an upper edge 32*c* that is secured about top cross member 26 by the studs 28 and 30. In the embodiment shown, the flexible cloth like material 32 is so shaped and suspended about the back area of the main frame structure 12 so as to define a generally trapezoidal shaped backrest.

Figure 4:
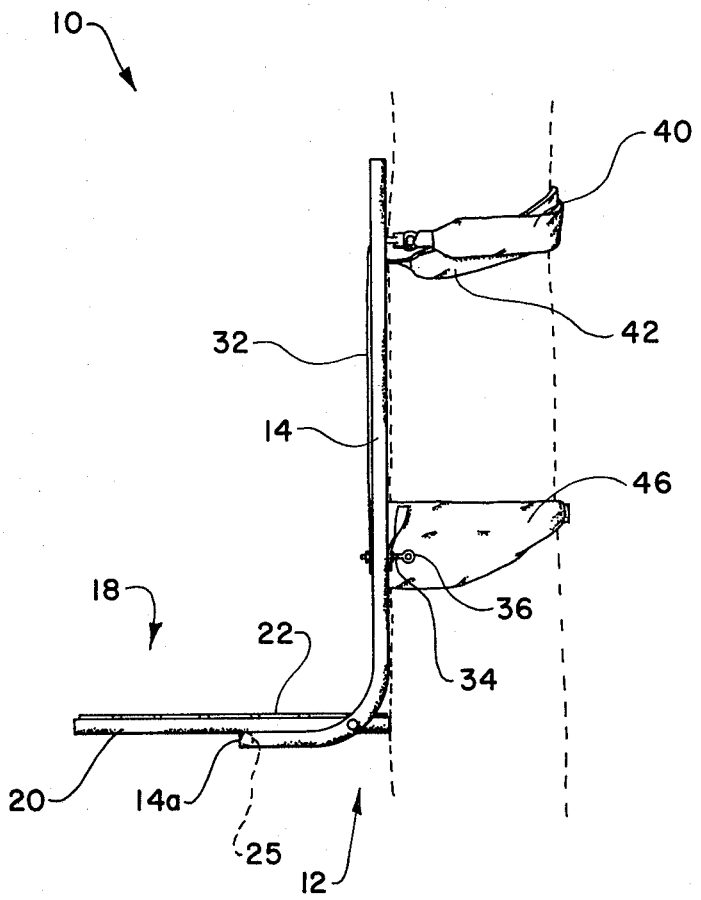
FIG. 4 is a side elevational view of the apparatus of the present invention showing its particular adaptation as a tree stand.

Continuing to refer to the multipurpose apparatus 10 of the present invention, it is seen that the same includes strap means disposed about the back area of the frame structure, and indicated generally by the numeral 38, for allowing the apparatus to be attached to a tree, as illustrated in FIG. 4, or to be appropriately suspended about an individual in order that the apparatus of the present invention may be used as a backpack frame.

Viewing the strapping means 38 in detail, it is seen that the same includes first and second straps 40 and 42, with each strap being preferably padded and anchored about one end to a respective eyelet stud 28 or 30 secured to top cross member 26. In addition, each strap 40 and 42 includes about the other end an attaching means in the form of a conventional eyelet hook 44. This allows the remote or loose end of each strap 40 and 42 to be attached either to the eyelets of studs 28 or 30, or to the eyelet 36 of stud 34.

In addition, apparatus 10 of the present invention is provided with an intermediate belt type strap indicated generally by the numeral 46 and which is provided with a tying end 50 and a buckle 48. Intermediate belt type strap 46 is anchored to main frame structure 12 by the studs 34 extending through respective laterally spaced side members 14 and 16 such that the intermediate belt type strap is disposed generally between the upper cross member 26 and the seat 18.

When used as a tree stand, as illustrated in FIG. 4, straps 40 and 42 are generally crossed as illustrated in FIG. 4 and attached around the tree such that the entire apparatus 10 may be supported about that tree above the ground. In particularly, each strap is wrapped around the tree and attached to a respective adjacent eyelet 28 or 30 mounted on cross member 26. As additional support, when used as a tree stand, the intermediate belt type strap 46 may also be secured about the tree, as indicated in FIG. 4, or the same intermediate belt type strap can be utilized as a seat belt. It is seen in FIG. 4 that the rear edge of the seat frame 20 and the upper cross member 26 engage the tree and the retaining effects of the straps enable the apparatus to be snugly held about the tree without any adverse effects to the tree such as damage or scarring.

As illustrated in FIG. 2, the same apparatus 10 can be utilized as a backpack frame. In this case, straps 40 and 42 are pulled down across the back, and the eyelet hooks 44 of each are secured to a respective eyelets 36. In addition, the intermediate belt type strap 46 is attached around the waist so as to enable some of the load to be carried about the individual's waist.

From the foregoing specification, it is seen that the multipurpose apparatus 10 is relatively simple in construction and can be manufactured relatively inexpensively. Yet the apparatus is very versatile and can be used as illustrated as a tree stand for hunting and as a backpack frame, as well as other uses. Other such uses include a carrier for wild game, firewood, etc., and in addition, the apparatus may be used as a seat for camping or as a seat when fishing since the entire apparatus could be suspended from a pier railing or other such structure. Although the structural components may be manufactured from various materials, it is desirable that the weight of the apparatus be minimized and yet that the apparatus be durable under ordinary use conditions. In this regard, the main frame structure and seat can be constructed from aluminum and by so doing, it is contemplated that a preferred size of the apparatus can be constructed that will weigh less than six pounds.

The terms "upper", "lower", "forward", "rearward", etc., have been used herein merely for the convenience of the foregoing specification and in the appended claims to describe the apparatus and its parts as oriented in the drawings. It is to be understood, however, that these terms are in no way limiting to the invention since the apparatus may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive and all changes coming within the meaning and equivalency range are intended to be embraced herein.

What is claimed is:

1. An apparatus adapted for multipurpose use such as a tree stand, backpack frame or the like comprising: a main frame structure including two laterally spaced side members and at least one cross member interconnected between said side members to form a generally rigid frame structure, said main frame structure forming an upper back area and a lower seat support area with said seat support area extending angularly from said back area and wherein respective ends of said laterally spaced side members are curved to form said seat support area such that the curved ends of said laterally spaced side members extend outwardly generally perpendicular to the part of said side members forming said back area; back support means secured about said back area of said main frame structure and extending between said laterally spaced side members to form a backrest; a seat secured about said seat support area of said main frame structure with said seat being pivotably mounted about a transverse axis extending between the curved portions of said laterally spaced side members of said main frame structure and movable from a horizontal support position generally perpendicular to the back area of said main frame structure to a vertical position wherein said seat lies and extends in a generally parallel relationship with the back area of said main frame structure; seat support means associated with said seat support area of said main frame structure for supporting said seat in said horizontal position by limiting the pivotable movement of said seat about said transverse axis; and strap means operatively connected to the back area of said main frame structure for enabling the entire apparatus to be strapped or tied to a structure such as a tree or the like whereby said apparatus may be suspended and supported from that structure.

2. The apparatus of claim 1 wherein said seat support means comprises a transverse member secured transversely generally about the terminal ends of the curved seat support portions of said laterally spaced side members of said main frame structure, such that when said seat assumes the horizontal support position the bottom thereof rests adjacent to and in contact with said transverse member.

3. The apparatus of claim 2 wherein said seat includes a rectangular frame and an expanded metal seat secured to said rectangular tubular frame.

4. The apparatus of claim 3 wherein said rectangular frame includes a plurality of spaced apart reinforcing members extending across said rectangular frame for providing additional support for said expanded metal seat.

5. The apparatus of claim 3 wherein said laterally spaced members are each of an aluminum tubular construction.

6. The apparatus of claim 2 wherein said at least one cross member interconnecting said laterally spaced members is disposed about said back area of said main frame structure, and wherein said back support means includes a flexible cloth like material secured about opposite lower edges to said laterally spaced side members of said main frame structure about the back area thereof and extends upwardly therefrom where an upper portion of said flexible cloth like material is secured to said at least one cross member disposed transversely about said back area of said main frame structure.

7. The apparatus of claim 6 wherein said flexible cloth like material forming said back support means is cut and suspended about the back area of said main frame structure to form a generally trapezoidal shaped backrest.

8. The apparatus of claim 7 wherein said strap means comprises a pair of individual straps with each strap being secured about one end to one of two eyelets anchored to said at least one cross member extending across the back area of said main frame structure and wherein about the other end of each strap there is provided attaching means which allows the respective ends of said straps to be attached, whereby when used as a tree stand each of the straps can be wrapped around a tree with the attaching means secured to respective eyelets on said cross member while the same straps may be utilized as shoulder straps to support the apparatus about an individual's back when the same is used as a backpack frame wherein when used as a backpack frame said apparatus would be provided with means for receiving the attaching means of each strap about a point on said main frame structure below said cross member.

9. The apparatus of claim 8 wherein the apparatus is provided with an intermediate belt type strapping means secured to said main frame structure immediately between said one cross member extending across said back area of said main frame structure and said seat, whereby said belt type strapping means may be used as a seat belt, additional strapping for securing said apparatus about a tree or other type structure, or as a waist belt that is secured about an individual when the apparatus is used as a backpack frame.

* * * * *